US008519901B2

(12) United States Patent
Tu et al.

(10) Patent No.: US 8,519,901 B2
(45) Date of Patent: Aug. 27, 2013

(54) SLOT ANTENNA

(75) Inventors: Hsin-Lung Tu, Tu-Cheng (TW); Wen-Chien Mao, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 247 days.

(21) Appl. No.: 13/095,894

(22) Filed: Apr. 28, 2011

(65) Prior Publication Data

US 2012/0223868 A1 Sep. 6, 2012

(30) Foreign Application Priority Data

Mar. 4, 2011 (CN) ..... 2011 1 0052089

(51) Int. Cl.
*H01Q 13/12* (2006.01)

(52) U.S. Cl.
USPC ..... 343/769; 343/893

(58) Field of Classification Search
USPC ..... 343/893, 795, 700 MS, 770, 769, 343/846
See application file for complete search history.

(56) References Cited

U.S. PATENT DOCUMENTS

| | | | | |
|---|---|---|---|---|
| 7,265,717 | B2 * | 9/2007 | Saitou et al. | 343/700 MS |
| 2008/0062063 | A1 * | 3/2008 | Matsushita et al. | 343/846 |
| 2010/0295750 | A1 * | 11/2010 | See et al. | 343/893 |

* cited by examiner

*Primary Examiner* — Thien M Le
(74) *Attorney, Agent, or Firm* — Altis Law Group, Inc.

(57) ABSTRACT

A slot antenna is formed on a base. The base includes a first surface and an opposite second surface. The slot antenna includes a feeding portion formed on the first surface, a ground portion and a radiating portion formed on the second surface. The radiating portion includes a first radiating body being surrounded by a first slot, a second radiating body being surrounded by a second slot, a first switch and a second switch. The first switch is set between the first radiating body and the ground portion. The second switch is set between the second radiating body and the ground portion.

10 Claims, 6 Drawing Sheets

SLOT ANTENNA

BACKGROUND

1. Technical Field

The disclosure generally relates to slot antennas, and particularly to a slot antenna with multiple adjustable radiation patterns.

2. Description of Related Art

Many portable wireless communication devices include an antenna to transmit and receive electromagnetic waves. However, the antenna is susceptible to interference from electromagnetic waves generated by other electronic members such as a speaker, or a camera. In addition, the antenna commonly has different signal radiation abilities corresponding to different radiation angles. The antenna can be easily interfered with when it is at a radiation angle, which corresponds to weak radiation ability. Thus, if the antenna just has a single radiation pattern, it is difficult to adjust the radiation angle for less interference.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure

DETAILED DESCRIPTION

Figure 1:
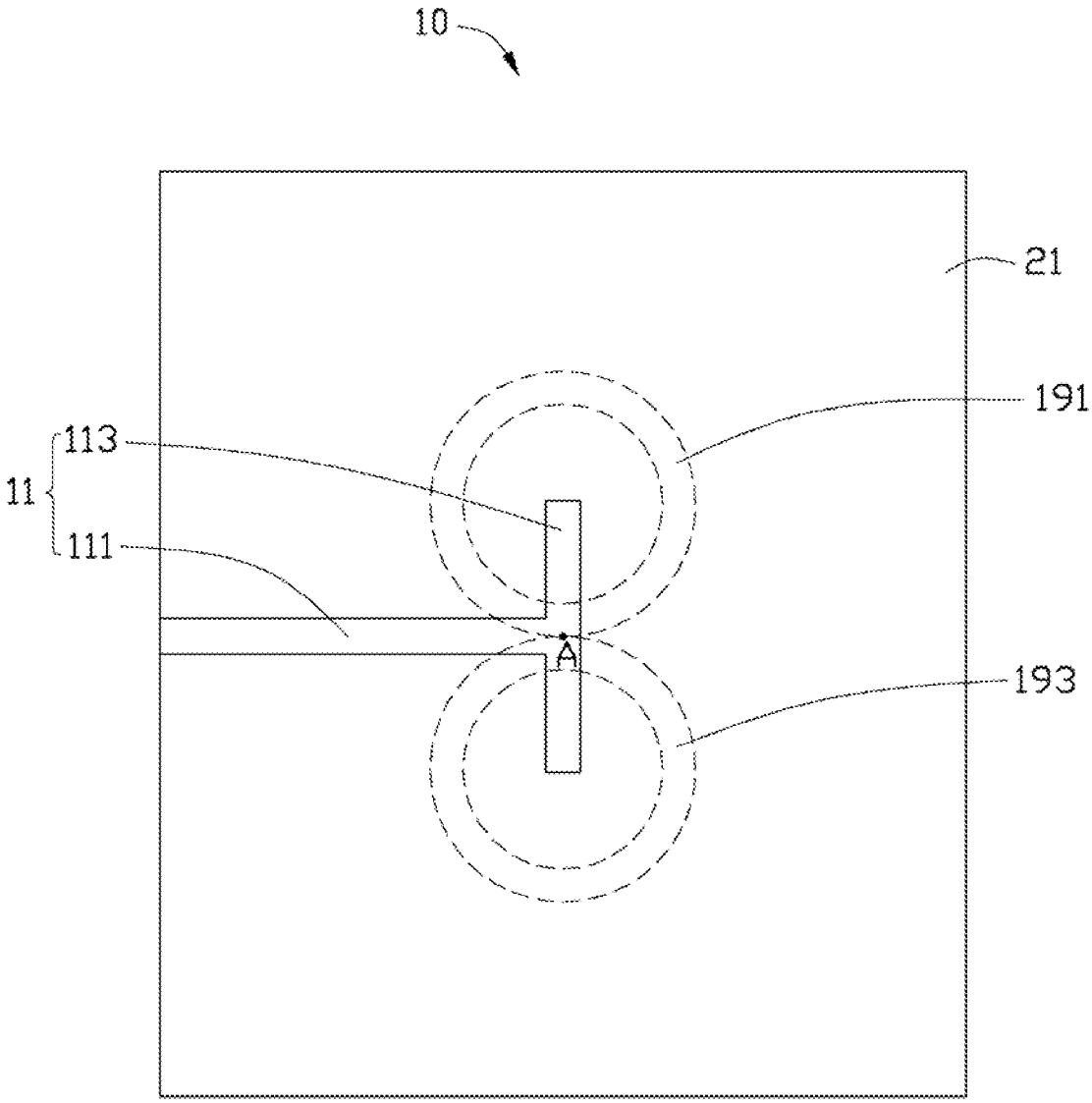
FIG. 1 is a schematic view of a slot antenna formed on a base, according to a first exemplary embodiment.
Figure 2:
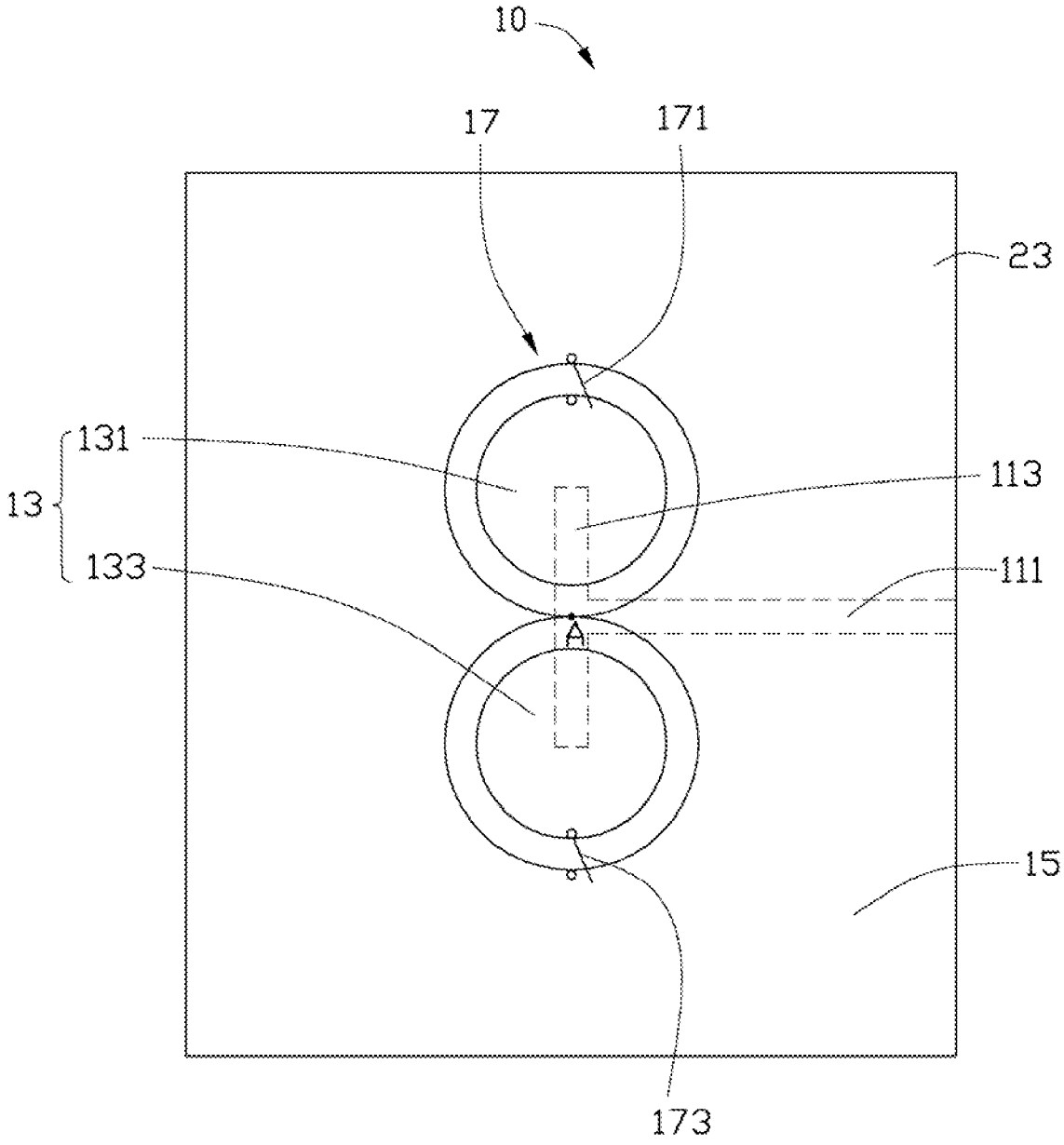
FIG. 2 is similar to FIG. 1, but showing the slot antenna in an opposite aspect.

Referring to FIGS. 1 and 2, a slot antenna 10 is formed on a base 20, according to a first exemplary embodiment. The base 20 includes a first surface 21 and a second surface 23 opposite to the first surface 21. The slot antenna 10 includes a feeding portion 11, a radiating portion 13, a ground portion 15 and a switch unit 17. The feeding portion 11 is formed on the first surface 21. The radiating portion 13, the ground portion 15 and the switch unit 17 are formed on the second surface 23.

The feeding portion 11 is a substantially T-shaped sheet which includes a first feeding strip 111 and a second feeding strip 113. The second feeding strip 113 is longitudinally located at the center of the base 20. The first feeding strip 111 is perpendicularly connected to a middle portion of the first feeding strip 111 and horizontally located between an edge of the base 20 and the second feeding strip 113.

The radiating portion 13 includes a first radiating body 131 and a second radiating body 133. The first and second radiating bodies 131, 133 are two substantially circular sheets. A circular first slot 191 is defined in the base 20 surrounding the first radiating body 131. A circular second slot 193 is defined in the base 20 surrounding the second radiating body 133. The first slot 191 and the second slot 193 are externally tangent to each other and have a tangency point A. The tangency point A is substantially a central point of the base 20.

The ground portion 15 is formed from the base 20. That is a portion of the base 20 which excludes the first and second radiating bodies 131, 133, and the first and second slots 191, 192.

The switch unit 17 includes a first switch 171, and a second switch 173. The first switch 171 is set between the first radiating body 131 and the ground portion 15. The second switch 173 is set between the second radiating body 133 and the ground portion 15. In this exemplary embodiment, the first and second switches 171, 173 may be diodes, and transistors. The first and second switches 171, 173 can be switched to control radiation patterns of the slot antenna 10.

When the first and second switches 171, 173 are turned on, the slot antenna 10 switches in a first radiation pattern. When the first switch 171 is turned on, and the second switch 173 is turned off, the slot antenna 10 switches in a second radiation pattern. When the first and second switches 171, 173 are turned off, the slot antenna 10 switches in a third radiation pattern.

Figure 3:
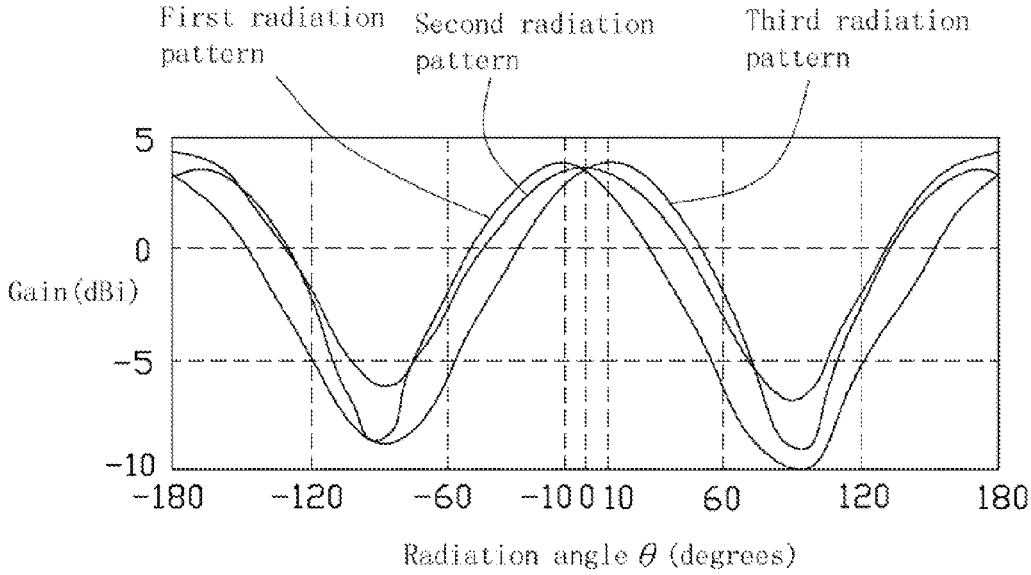
FIG. 3 is an exemplary test graph obtained from the slot antenna of FIG. 1, disclosing gain varying with multiple radiation angles.

Referring to FIG. 3, in the first radiation pattern, the radiation angle of the slot antenna 10 corresponding to the greatest gain is about 0 degrees. In the second radiation pattern, the radiation angle of the slot antenna 10 corresponding to the greatest gain is about −10 degrees. In the third radiation pattern, the radiation angle of the slot antenna 10 corresponding to the greatest gain is about 10 degrees.

Figure 4:
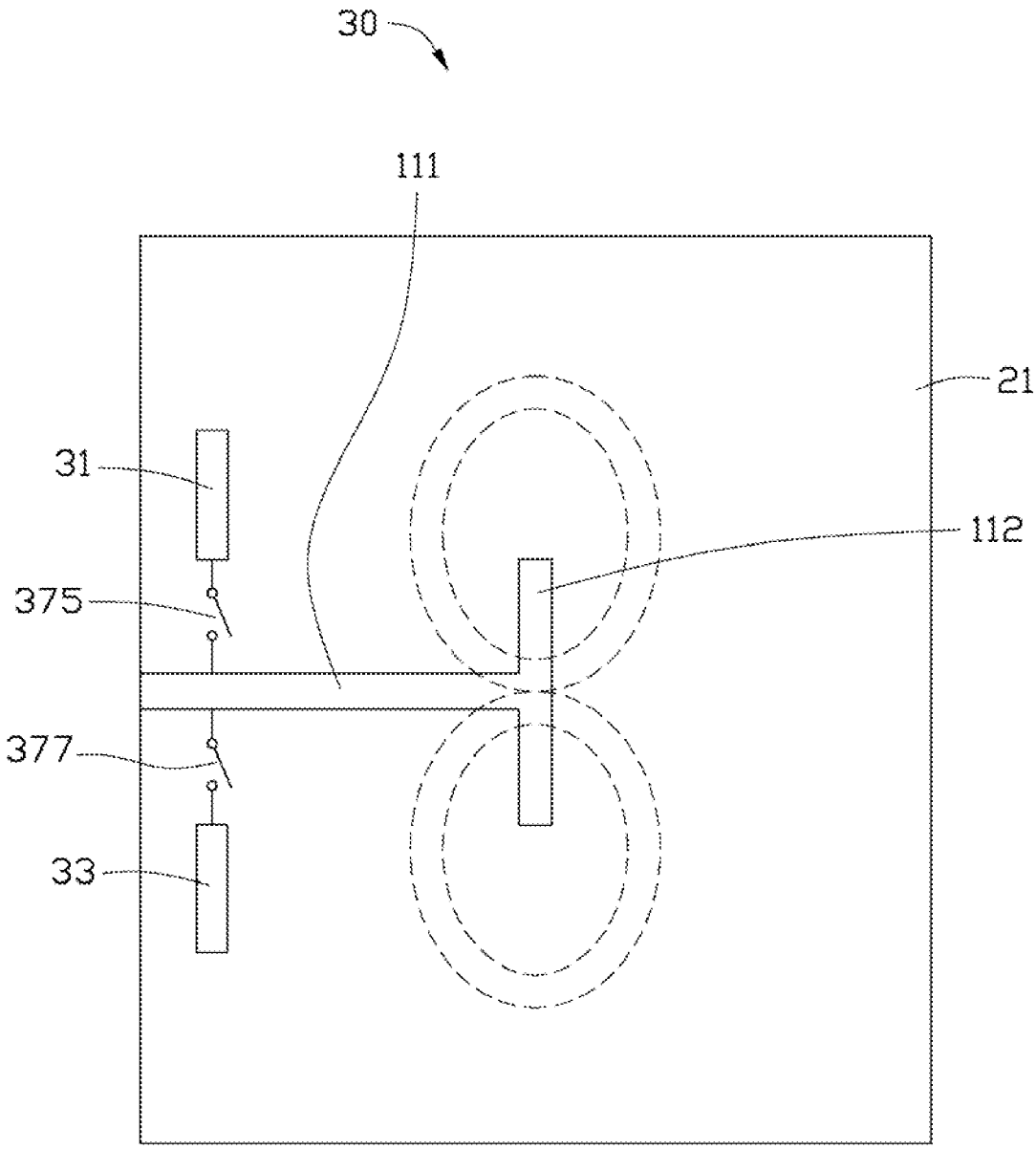
FIG. 4 is a schematic view of a slot antenna formed on a base, according to a second exemplary embodiment.
Figure 5:
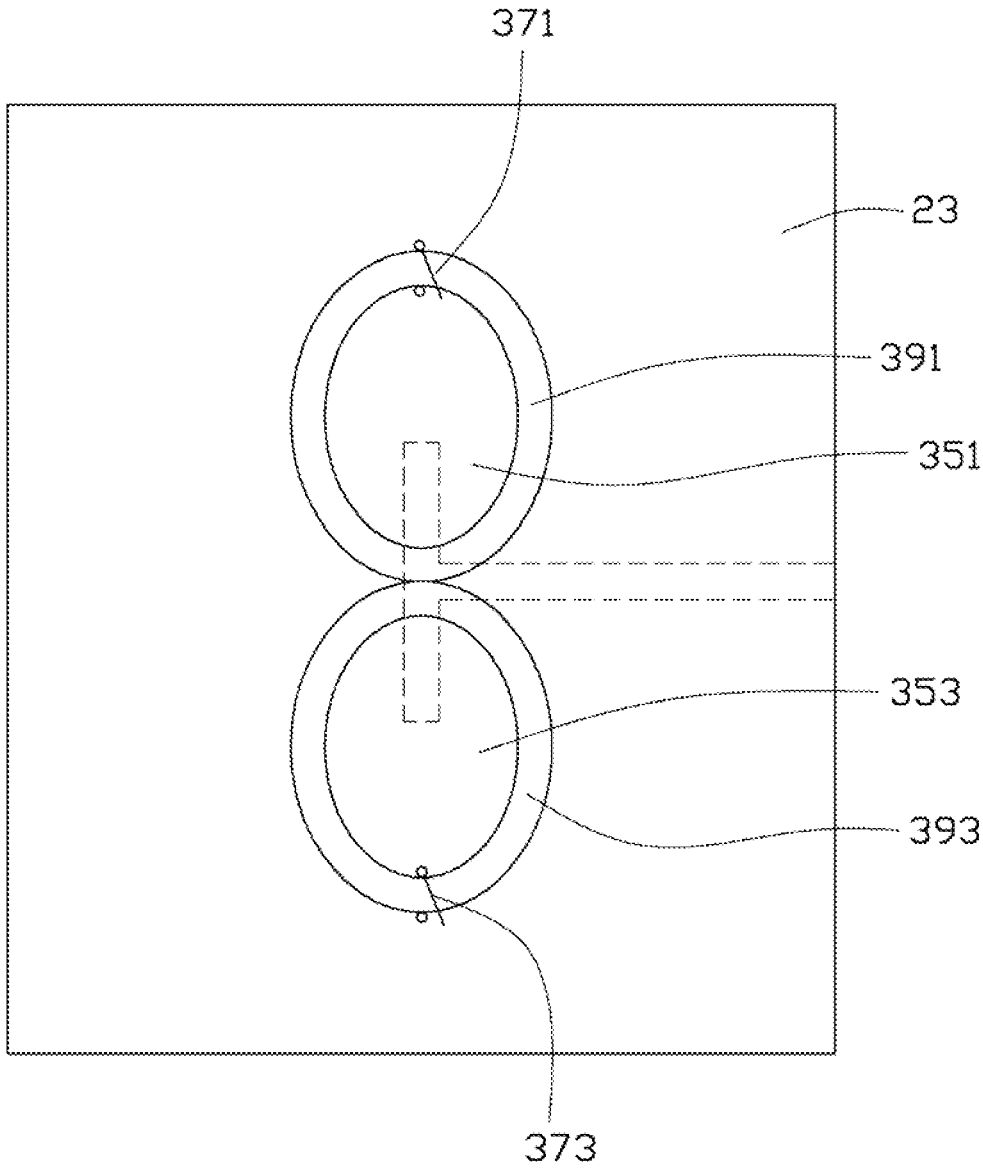
FIG. 5 is similar to FIG. 4, but showing the slot antenna in an opposite aspect.

Referring to FIGS. 4 and 5, a slot antenna 30, according to a second exemplary embodiment, is substantially similar to the slot antenna 10, but further includes a first radiating strip 31, a second radiating strip 33, a third switch 375 and a fourth switch 377. In this exemplary embodiment, the first radiating body 351 and the second radiating body 353 are elliptic. The first radiating strip 31 and the second radiating strip 33 are formed on the second surface 23, and are symmetrically positioned at two opposite sides of the first feeding strip 111. The third switch 375 is set between the first radiating strip 31 and the first feeding strip 111. The fourth switch 377 is set between the second radiating strip 33 and the first feeding strip 111. The first to fourth switches 371, 373, 375, 377, control the radiation patterns of the slot antenna 30. The first switch 371 and the third switch 375 have the same off/on state. The second switch 373 and the fourth switch 377 have the same off/on state.

When the first, second, third and fourth switches 371, 373, 375, 377 are turned off, the slot antenna 30 switches in a fourth radiation pattern. When the first and third switches 371, 375 are turned on, and the second and fourth switches 373, 377 are turned off, the slot antenna 30 switches in a fifth radiation pattern. When the first and third switches 371, 375 are turned off, and the second and fourth switches 373, 377 are turned on, the slot antenna 30 switches in a sixth radiation pattern.

Figure 6:
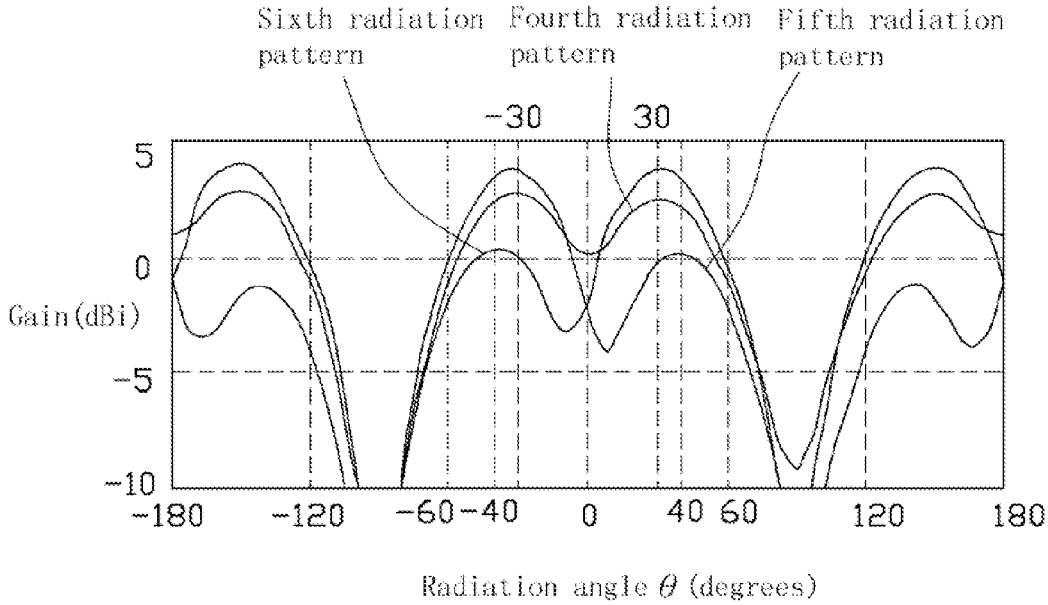
FIG. 6 is an exemplary test graph obtained from the slot antenna of FIG. 4, disclosing gain varying with multiple radiation angles.

Referring to FIG. 6, in the fourth radiation pattern, the radiation angles corresponding to the greatest gain are about −30 degrees and 30 degrees. In the fifth radiation pattern, the radiation angle corresponding to the greatest gain is about 40 degrees. In the third radiation pattern, the radiation angle corresponding to the greatest gain is about −40 degrees.

Therefore, the slot antennas 10, 30 achieve multiple radiation patterns by controlling the status of the switches. The radiation angles can be adjusted to improve the sensitivity of the slot antennas 10, 30.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A slot antenna formed on a base, the base including a first surface and an opposite second surface, the slot antenna comprising:

a feeding portion formed on the first surface, the feeding portion including a first feeding strip and a second feeding strip, the first feeding strip being perpendicularly connected to a middle portion of the second feeding strip and horizontally located between an edge of the base and the second feeding strip;

a ground portion formed on the second surface;

a radiating portion formed on the second surface, the feeding portion and the ground portion positioned on the radiating portion, the radiating portion comprising:

a first radiating body surrounded by a first slot;

a second radiating body surrounded by a second slot;

a first switch set between the first radiating body and the ground portion; and a second switch set between the second radiating body and the ground portion.

2. The slot antenna as claimed in claim 1, wherein the first and second radiating bodies are two circular sheets, the first and second slots are tangent to each other.

3. The slot antenna as claimed in claim 2, wherein the first and second radiating bodies have a tangent point, and the tangent point is a center of the base.

4. The slot antenna as claimed in claim 3, wherein orthographic projections of a connection point of the first feeding strip and the second feeding strip and the tangent point on the base coincide with each other.

5. The slot antenna as claimed in claim 1, wherein the feeding portion is T-shaped.

6. The slot antenna as claimed in claim 5, wherein the second feeding strip is longitudinally located at the center of the base.

7. The slot antenna as claimed in claim 1, wherein the first and second radiating bodies are two elliptic sheets, the first and second slots are tangent to each other.

8. The slot antenna as claimed in claim 7, further comprising a first radiating strip, a fourth radiating strip, a third switch, and a fourth switch, wherein the third switch is set between the first radiating strip and the first feeding strip, the third switch is set between the second radiating strip and the first feeding strip.

9. The slot antenna as claimed in claim 8, wherein the first radiating strip and the second radiating strip are symmetrically disposed at two opposite sides of the first feeding strip.

10. The slot antenna as claimed in claim 1, wherein orthographic projections of the second feeding strip and diameters of the first radiating body and the second radiating body on the base partially coincide with each other.

* * * * *